United States Patent [19]

Shoaf

[11] 4,051,953

[45] Oct. 4, 1977

[54] PIVOTAL SUPPORT

[76] Inventor: Walter D. Shoaf, R.D. 2, Atwood Drive, Belle Vernon, Pa. 15012

[21] Appl. No.: 665,055

[22] Filed: Mar. 11, 1976

[51] Int. Cl.[2] ..... A47F 5/08; D06F 53/00

[52] U.S. Cl. ..... 211/119.1; 211/100; 248/293; 105/475

[58] Field of Search ..... 211/7, 8, 4, 99, 100, 211/111, 171, 119.1, 101, 119.16; 248/294, 301, 304, 308, 291, 293

[56] References Cited

U.S. PATENT DOCUMENTS

| | | | |
|---|---|---|---|
| 1,419,563 | 6/1922 | Horning | 248/DIG. 3 |
| 1,425,355 | 4/1890 | Ward | 248/294 |
| 1,892,687 | 1/1933 | Teufel | 248/293 |
| 2,492,701 | 12/1949 | Kirk | 211/100 |
| 2,643,000 | 6/1953 | Morrison | 211/100 |
| 2,887,233 | 5/1959 | Bybee | 211/119.1 X |

FOREIGN PATENT DOCUMENTS

| | | | |
|---|---|---|---|
| 272,250 | 6/1959 | Austria | 211/100 |

*Primary Examiner*—Roy D. Frazier
*Assistant Examiner*—Terrell P. Lewis
*Attorney, Agent, or Firm*—Wilfred G. Caldwell

[57] ABSTRACT

The invention is a self-storing pivotally extending support for articles of apparel, clotheslines or the like. A mounting plate includes a pair of spaced apart ears with a pivotal pin axis carried by the ears. An arm slides vertically between the mounting plate and pivot axis pin and has a hook on its thickened forward end and an abutment rear end including an offset slot. The arm is moved upwardly until the offset slot permits slight lateral movement relative to the mounting plate by receiving the axis pin. This enables the arm to be pivoted to the horizontal or operative position with the abutment rear abutting the mounting plate to prevent further downward movement of the hook. The forward end is heavier than the rear end to enable gravity to assist in maintaining the operative or horizontal position. A hitch pin fits through an aperture in the arm to lock it in the vertical or storage position.

4 Claims, 4 Drawing Figures

PIVOTAL SUPPORT

The present invention comprises a pivotal support having an operative and inoperative storage position. The support may be used singly as a clothes or towel rack or the like or may be used in combination as a clothesline hanger, the line being strung between one pivotal support and a stationary object such as a shower head or tree or between two pivotal supports at spaced apart locations such as on a recreational vehicle.

The pivotal support includes a mounting bracket for attachment to the wall for interior use or to the exterior frame of an RV for exterior use.

The mounting bracket includes a pivotal axis pin offset from the mounting plate by a pair of spaced apart ears between which the shank or arm is carried. The arm carries a hook at the forward end thereof and a pivotal bracket with an offset slot at the rear end.

In the inoperative position the arm is vertical with the hook portion resting against the pivotal axis pin and wall mounting plate. A hitch pin is provided for locking the arm in the inoperative position for storage and travel.

Removal of the hitch pin permits the arm to be raised until the bracket end of the arm pivots about the pivot axis pin as a result of the bracket portion receiving the axis pin in the slot offset so that the pivot arm is oriented into the horizontal position. The rear end of the arm includes an abutment at approximately 90° to the longitudinal axis of the arm for contact with the mounting plate to support the arm in the horizontal position.

The hook portion of the arm is heavier by virtue of being thickened so that gravity insures maintaining the arm in the operative position once it is positioned there and also assists in quickly locating the arm in the inoperative position by assisting in the sliding of the arm vertically downwardly. The hitch pin, of course, may be stored in the aperture of the arm when in the operative position above and beyond the pivot axis pin and may be used to lock the arm in the inoperative position by being located in the aperture now beneath the ears to retain the arm in the storage position.

The pivotal support is designed especially for fabrication by casting to produce a very inexpensive but reliable support. It may be sand or die cast from aluminum, and only the hitch pin and pivot axis pin need by purchased items.

The invention will be further described in detail in connection with the accompanying drawings wherein.

Figure 1:
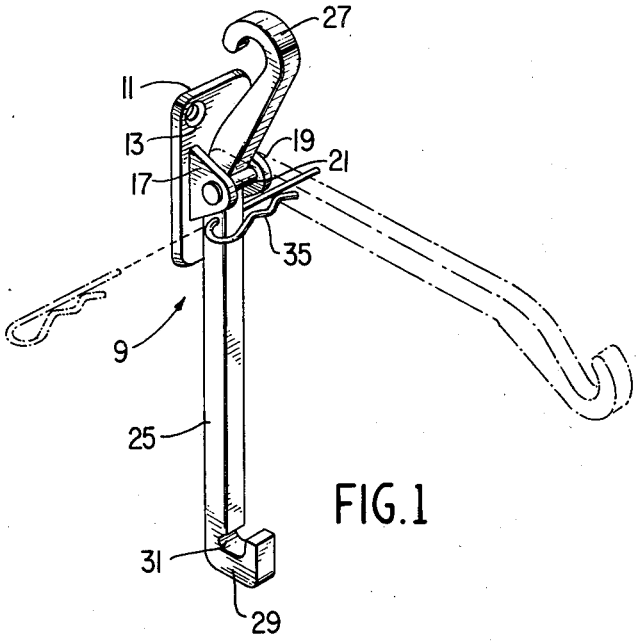
FIG. 1 depicts the pivotal support in perspective with phantom outline alternative positions for the arm and the hitch pin.
Figure 2:
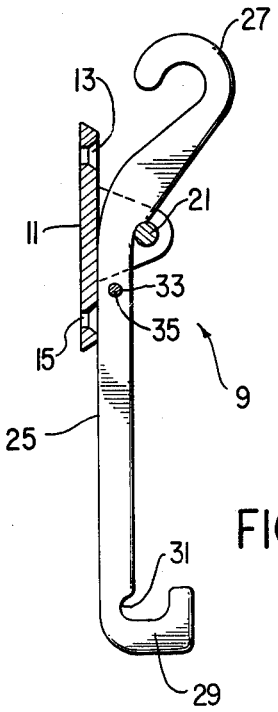
FIG. 2 is a view in side elevation of the arm and in section of the mounting plate with the arm in the storage or inoperative position.
Figure 3:
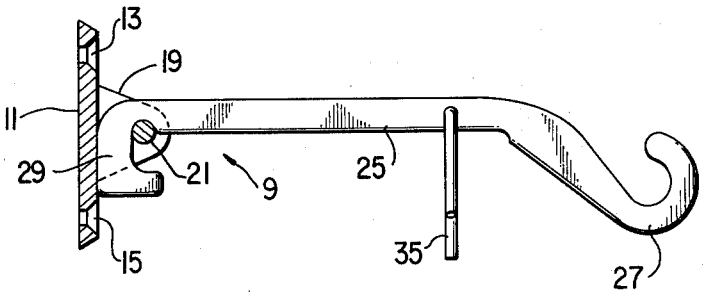
FIG. 3 shows the arm in operative position with the mounting plate in section; and, FIG. 4 shows a pair of pivotal supports in spaced apart locations on an RV with a clothesline supported between them.

Considering now FIGS. 1 through 3, the pivotal support 9 comprises a mounting plate 11 having a pair of countersunk apertures 13 and 15 for screw fasteners. The spaced apart ears (cast integrally with plate 11) are shown at 17 and 19. The ears 17 and 19 are apertured to receive the horizontal axis pivot pin 21 which preferably is an inexpensive rivet but may be a threadable screw or bolt or the like.

The support arm 25 includes a thickened forward end portion terminating in a hook 27 and a rear abutment portion 29 with offset slot 31. Also, the arm 25 includes an aperture 33 to receive hitch pin 35 for maintaining the arm in storage position substantially locked against movement by the ears 17 and 19. The thickened portion of arm 25 adjacent hook 27 will not pass downwardly between the pin 21 and mounting plate 11, and the hitch 35 when inserted in aperture 33 prevents upward passage of arm 25.

Alternatively, the curvature of arm 25 in forming hook 27 may be sufficiently great as to prevent passage of the forward end between mounting plate 11 and pin 21. Also, if desired, the bottom surface of arm 25 may be slightly recessed at pin 21 in the position shown in FIG. 2 better to nest the arm 25 in its storage position.

In operation, the hitch pin 35 is removed and the arm 25 is raised until the bottom recess 31 bears against pin 21. Then slight forward movement of arm 25 serves to cause the offset portion of recess 31 to receive pin 21 thereby affording sufficient clearance for pivoting the arm 25 from the storage position to the operative position. The latter position is maintained, as is best seen in FIG. 3, as a result of the abutting engagement between mounting plate 11 and arm abutment 29.

Thus, it may be appreciated that the invention provides a most inexpensive arrangement for securing arm 25 in a useful of operative supporting position as in FIG. 3 or in a storage position as in FIG. 1 without the necessity of springs, sockets or other unreliable locking structure.

The pivotal support of the present invention is useful in a great many applications. It may, for example, provide a support for receiving clothes in the home. In the bathroom, it may extend over the tub to receive wet towels or freshly washed shirts or other apparel on hangers, hook 27 receiving items directly or indirectly as by supporting hangers for such items. Also, it finds many uses in factories and other locations where it is desirable to utilize the flush storage capabilities when it is not in use.

Figure 4:
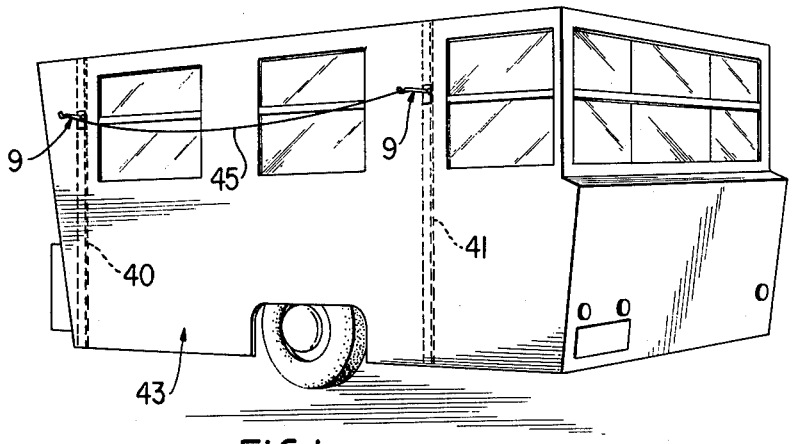

Finally, for recreational camping, the support finds use for wet bathing suits or for hanging a clothesline. Such a line may be anchored to a single support and extended to a neighboring tree or natural support, or, as in the case of FIG. 4, a pair of the supports 9 are shown mounted to frame members 40 and 41 of RV 43 in operative positions to carry the clothesline 45. The locked storage position is, of course, utilized for travel.

If desired, the mounting plate may be secured to the ceiling or other horizontal surface and the arm extended downwardly into the operating position. However, such a location does not afford utilization of gravity to maintain the operative position stable, but nevertheless is useful in some applications.

What is claimed is:

1. A pivotal support for use on a recreational vehicle comprising in combination:

a mounting plate adapted to be flush-mounted to an exterior surface of said vehicle and having a pair of spaced apart ears extending outwardly thereof;

a pivot pin carried by the ears in spaced relation to the mounting plate;

an arm positioned in a storage position between said pin and said plate and slidable relative thereto;

said arm including an aperture;

a hitch pin adapted to grip said arm via said aperture to lock it in said storage position;

said arm terminating in a forward hook and a rear abutment, said abutment having an offset slot for receiving said pivot pin to permit the arm to be pivoted from the storage position to an operative position oriented approximately 90° from said storage position with the abutment bearing against said mounting plate when the arm is in the operative position to maintain the arm in said operative position; and, the thickness of said arm between the forward hook and rear abutment being less than the distance between the pivot pin and said mounting plate whereby the arm is moved from said storage position by sliding the portion of the arm between said forwrd hook and said rear abutment upwardly for pivoting about the pivot pin into said operative position.

2. The pivotal support of claim 1 wherein the hook of said arm is thicker than the rest of the arm, whereby the thickness of the hook prevents it from passing between the pivot pin and mounting plate.

3. The pivotal support of claim 1 wherien said offset slot in said rear abutment extends into said arm at an angle approximately 90° to the longitudinal axis of the arm to permit lateral movement between the arm and pin when the latter is within said slot thereby facilitating pivoting of the arm relative to the plate.

4. The pivotal support of claim 1 wherein the end of said arm forming the hook is heavier than the end of the arm forming the rear abutment to enable gravity to assist in maintaining the arm in its operative position.

* * * * *